US006210219B1

(12) United States Patent
Zhu et al.

(10) Patent No.: US 6,210,219 B1
(45) Date of Patent: Apr. 3, 2001

(54) LOW PROFILE ELECTRICAL CONNECTOR WITH IMPROVED BOARD LOCK

(75) Inventors: ZiQiang Zhu; ZhiQuan Mou, both of Kun-San (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/457,610

(22) Filed: Dec. 8, 1999

(30) Foreign Application Priority Data

Nov. 9, 1999 (TW) ..... 88219099

(51) Int. Cl.[7] ..... H01R 13/73
(52) U.S. Cl. ..... 439/567; 439/939
(58) Field of Search ..... 439/79, 567, 607, 439/609, 939

(56) References Cited

U.S. PATENT DOCUMENTS 5,334,049 * 8/1994 Kachlic ..... 439/567
5,702,271 * 12/1997 Steinman ..... 439/676
5,709,556 * 1/1998 Tan et al. ..... 439/79
5,865,645 * 2/1999 Embo et al. ..... 439/567
6,074,225 * 6/2000 Wu et al. ..... 439/939
6,077,115 * 6/2000 Yang et al. ..... 439/567
6,083,044 * 7/2000 Wang et al. ..... 439/567
6,095,853 * 8/2000 Huang et al. ..... 439/567

* cited by examiner

*Primary Examiner*—Gary F. Paumen
(74) *Attorney, Agent, or Firm*—Wei Te Chung

(57) ABSTRACT

A low profile electrical connector of the present invention comprises a housing, a plurality of terminals received in the housing, a shield covering a front of the housing, a pair of grounding members attached to the shield, a bracket mountable on a printed circuit board for engaging with the housing, and a pair of board locks mounted to the bracket for engaging with a printed circuit board. The bracket includes a base comprising a top face and a bottom face, a pair of spacing plates projecting upwardly from a top face of the base, and two mounting portions situated at a front of the base. A bottom end of the mounting portion is lower than the bottom face of the base. The bottom face of the base is mounted to an edge of the circuit board. A finger extends forward from the grounding member, which is engaged with a front face of the shield, to establish electrical grounding contact with a panel of a computer.

1 Claim, 2 Drawing Sheets

LOW PROFILE ELECTRICAL CONNECTOR WITH IMPROVED BOARD LOCK

FIELD OF THE INVENTION

The present invention relates to a connector, and particularly to a low profile connector with an improved board lock for mounting on a circuit board.

BACKGROUND OF THE INVENTION

A surface-mounted electrical connector used for mating with a complementary connector is often mounted on a circuit board using the lowest surface of the connector. The total height required by the connector and the circuit board equals the height of the connector plus the thickness of the circuit board. Much space inside of a computer is occupied, which is counter to the present trend forward miniaturization in the telecommunication industry. A connector with a lower profile is desired. Examples of such electrical connectors are disclosed in U.S. Pat. Nos. 5,334,049; 5,709,556 and 5,702,271. However, the board locks disclosed in these connector designs do not engage with the connectors as securely as could be desired. A tighten engagement between the board lock and the connector will allow the connector to be fixed to a printed circuit board more reliably. Hence, an improved electrical connector is required to overcome the disadvantages of the prior art.

BRIEF SUMMARY OF THE INVENTION

A first object of the present invention is to provide an electrical connector mountable onto a circuit board such that the topmost surface of the connector has a minimized height above the circuit board;

A second object of the present invention is to provide an electrical connector having a pair of improved board locks which securely mount the electrical connector on the printed circuit board in cooperation with a bracket of the electrical connector;

A third object of the present invention is to provide an electrical connector having a pair of grounding members mounted on both ends of the shield for establishing a grounding contact with a panel of the computer.

To achieve the above objects, a low profile electrical connector of the present invention comprises a housing, a plurality of terminals received in the housing, a shield covering the housing, a pair of grounding members attached to the shield, a bracket mounted on a printed circuit board engageable with the housing, and a pair of board locks mounted to the bracket and engageable with the printed circuit board. The bracket includes a base comprising a top face and a bottom face, a pair of spacing plates projecting upwardly from a top face of the base, and two mounting portions situated at a front of the base. A bottom end of the mounting portion is lower than the bottom face of the base. The bottom face of the base is mounted to an edge of the circuit board. A finger extends forward from the grounding member, which is engaged with a front face of the shield, to establish electrical grounding contact with a panel of a computer.

Other objects, advantages and novel features of the invention will become more apparent from the following detailed description of the present embodiment when taken in conjunction with the accompanying drawings.

DETAILED DESCRIPTION OF THE INVENTION

Figure 1:
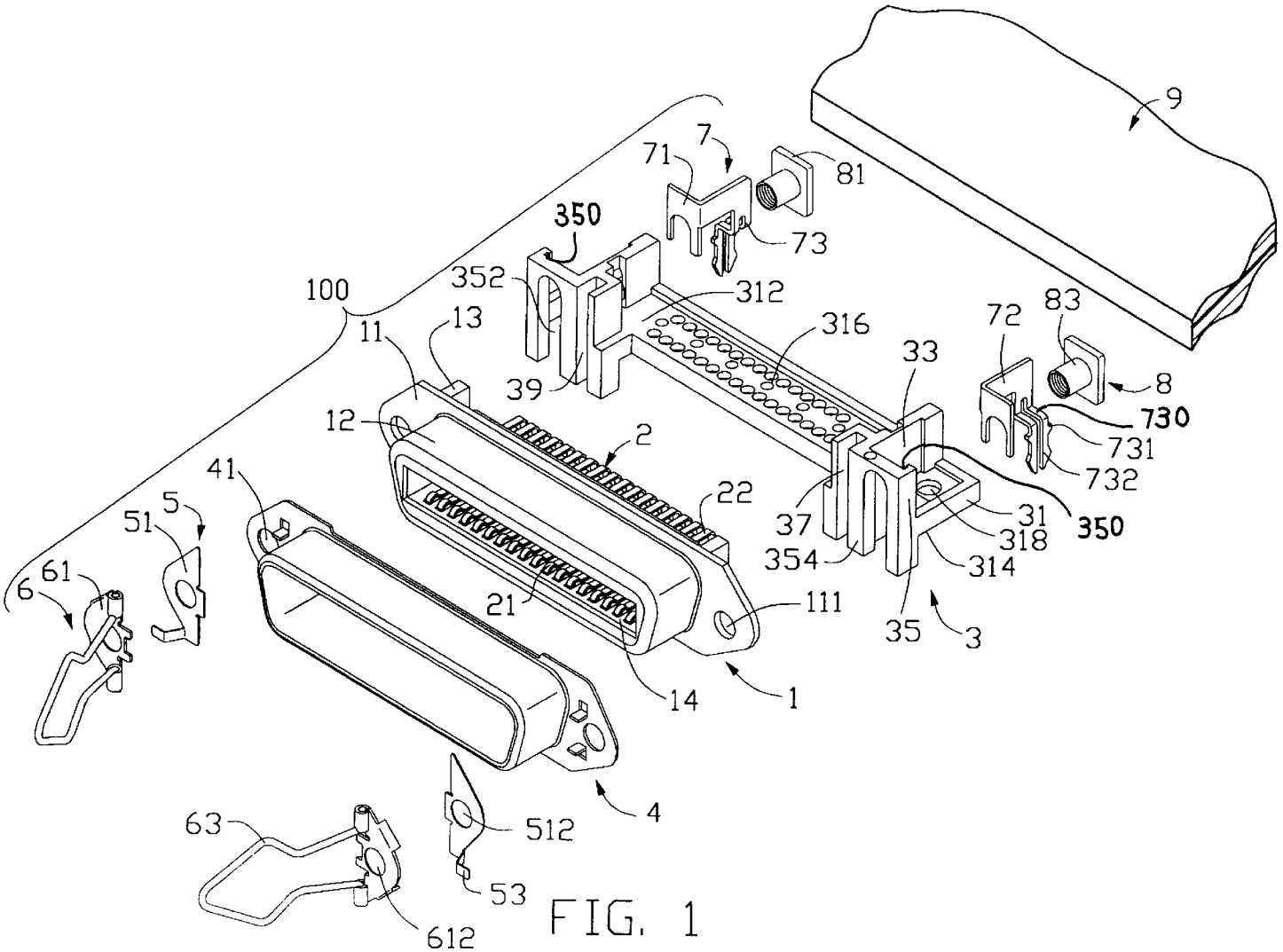
FIG. 1 is an exploded view of a low profile electrical connector with improved board locks in accordance with the present invention.

Referring to FIG. 1, a low profile electrical connector 100 constructed in accordance with the present invention comprises an elongate insulative housing 1, a plurality of terminals 2 received in the insulative housing 1, a shield 4 covering a front of the housing 1, a pair of grounding members 5 attaching to the shield 4, a bracket 3 mountable on an edge of a printed circuit board 9 and receiving the housing 1 which is assembled there to, and a pair of board locks 7 mounted on both ends of the bracket 3 by a pair of rivets 8 for engaging with the printed circuit board 9. Moreover, the low profile electrical connector 100 further comprises a pair of locking members 6 for securely engaging with a device (not shown) of a complementary mating connector.

The insulative housing 1 comprises a face 11 forming a mating projection 12 extending forwardly therefrom and two ribs 13 extending rearwardly therefrom. Two first through holes 111 are defined at both ends of the face 11. A mating slot 14 is defined through the housing 1 from a front edge (not labeled) of the mating projection 12 to a rear side (not shown) of the face 11. Each of the plurality of terminals 2 is bent in an L-shape and has a contact portion 21 at one end thereof received in the mating slot 14 of the insulative housing 1, and a tail portion 22 at the other end thereof.

The bracket 3 has an elongate base 31, which has a top face 312 and a bottom face 314 opposite the top face 312. A plurality of positioning holes 316 is defined in the base 31 from the top face 312 to the bottom face 314 thereof. Two retaining holes 318 are defined at both ends of the base 31. A pair of spacing plates 33 extends upwardly from the base 31 each situated between the plurality of position holes 316 and one of the retaining holes 318 at opposite ends of the base 31. Two mounting portions 35 are formed at opposite sides of a front of the base 31. An inverted U-shape slot 352 is defined in each mounting portion 35. Two bottom ends 354 are defined at a lower end of each mounting portion 35 beside the slots 352 and these bottom ends 354 are lower than the bottom face 314 of the base 31. A pair of wings 37 inwardly and forwardly extends from the spacing plates 33 to define a groove 39 together with the mounting portion 35 for receiving the rib 13 of the insulative housing 1.

The board lock 7 has a first wall portion 71 receiveably attached to the groove 350 of the mounting portion 35, and a second wall portion 72 perpendicular to the first wall portion 71. A pair of locking legs 73 vertically depends from the second wall portion 72 with a horizontal section 730 supportably seated on the base 31. A positioning stop 731 laterally projects from each of the locking legs 73 for pressing against the retaining holes 318 of the bracket 3. An engaging barb 732 is formed at the end of each locking leg 73 for extending through the retaining hole 318 and engaging with the sides of a mounting hole (not shown) in the circuit board 9.

The elongate shield 4 defines two second through holes 41 at both ends thereof. Each grounding member 5 has a main body 51 attaching to the shield 4. A third through hole 512 is defined in the main body 51 of the grounding member 5. A finger 53 forwardly extends from the main body 51 of the grounding member 5 for contacting a computer panel (not shown) thereby establishing a path to ground though the computer panel and enhancing the EMI shielding effectiveness of the shield.

Each locking member 6 has a main plate 61 defining a fourth through hole 612. A resilient wire 63 is assembled at one edge of the main plate 61 of the locking member 6 for securely engaging with a device of a complementary mating connector (not shown). The rivet 8 has a base plate 81 from which extends a tube 83 for securing the various elements of the low profile electrical connector 100 together.

Figure 2:
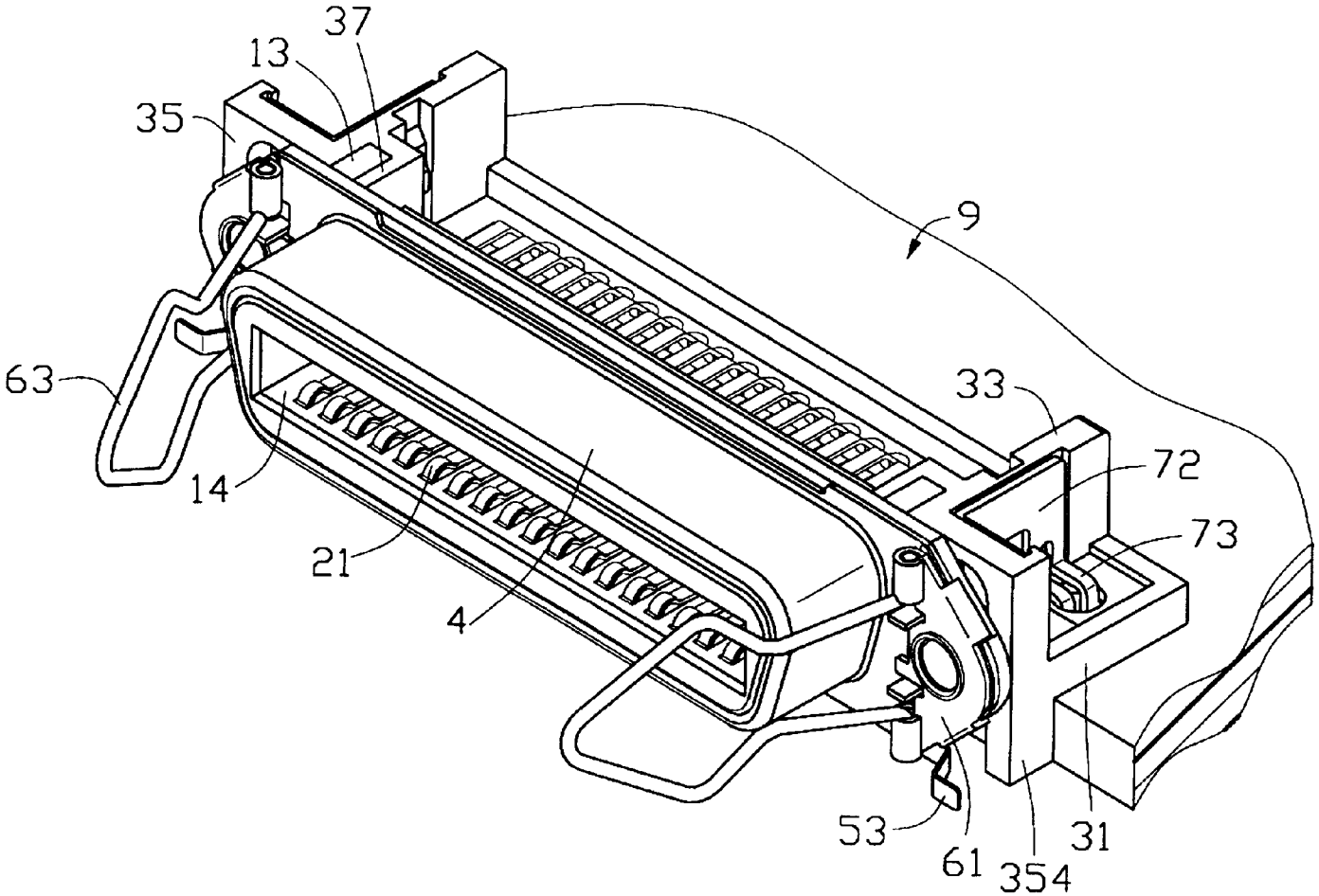
FIG. 2 is an assembled view of FIG. 1.

Referring to FIG. 2, in assembly, the tail portions 22 of the terminals 2 are received in the positioning holes 316 of the base 31 of the bracket 3. The board locks 7 are assembled to the bracket 3, the first wall portions 71 and the second wall portions 72 being securely fixed to the mounting portions 35 and the spacing plates 33 respectively. The locking legs 73 extend through the retaining holes 318, the positioning stop 731 interferentially engaging with an inner wall of the retaining holes 318 thereby securing the locking legs 73 in the retaining holes 318. The shield 4 covers the face 11 and the mating projection 12 of the housing 1. The tubes 83 of the pair of rivets 8 sequentially extend through the first wall portions 71 of the board lock 7, the slots 352 of the mounting portions 35 of the bracket 3, the first through holes 111 of the insulative housing 1, the second through holes 41 of the shield 4, the third through holes 512 of the grounding members 5 and the fourth through holes 612 of the locking members 6 and then rivet these elements together into a single assembly. Finally, the bottom face 314 of the bracket 3 is mounted to the circuit board 9, one edge of the circuit board 9 abutting the bottom ends 354 of the mounting portions 35, and the tail portions 22 of the terminals 2 and the engaging barbs 732 of the board locks 7 interferentially, fitting in and being soldered to the corresponding holes in the circuit board 9.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A low profile electrical connector comprising:

an insulative housing having a face and a mating projection projecting from the face, a mating slot being defined through the housing from a front edge of the mating projection to a rear side of the face;

a plurality of terminals each having a contact portion at one end thereof received in the mating slot and a tail portion at the other end thereof extending out of the insulative housing;

a bracket mounted on an edge of a printed circuit board and receiving the insulative housing, the bracket having a base defining a top face and a bottom face, a plurality of positioning holes through the top and the bottom faces for insertion of the tail portions of the terminals, a pair of spacing plates extending upwardly from the top face of the base, and two mounting portions at a front of the base, a bottom end of the mounting portion being lower than the bottom face of the base;

a pair of board locks each having a first wall portion, a second wall portion perpendicular to the first wall portion, and a pair of locking legs vertically depending from the second wall portion and through the base for securing the bracket to the circuit board, the first wall portion and the second wall portion securely affixed respectively to the mounting portion and the spacing plate of the bracket;

a metal shield covering the face and the mating projection of the insulative housing;

a grounding member having a main body attached to the shield, and a finger extending forward for contacting a computer panel; and a rivet extending through and securing the first wall portion of the board lock, the mounting portion of the bracket, the face of the housing, the shield, and the main body of the grounding member together;

wherein the base defines two retaining holes at opposite ends thereof for receiving the locking legs of the board locks, and a positioning stop laterally projects from each of the locking legs of the board lock for pressing against the inner wall of the retaining hole;

wherein each spacing plate is situated between the plurality of positioning holes and one of the retaining holes at opposite ends of the base;

wherein the mounting portion has an inverted U-shaped slot for the rivet to extend therethrough;

wherein two ribs rearwardly extend from the face of the insulative housing opposite to the mating projection, and a wing inwardly and forwardly extends from each spacing plate of the bracket to define a groove together with the spacing plate for receiving the rib;

further comprising a pair of locking members each assembled against a corresponding grounding member, and wherein the rivet secures the locking member against the corresponding grounding member.

* * * * *